US010119730B2

(12) United States Patent
Lin

(10) Patent No.: US 10,119,730 B2
(45) Date of Patent: Nov. 6, 2018

(54) HYBRID AIR HANDLER COOLING UNIT WITH BI-MODAL HEAT EXCHANGER

(71) Applicant: Liebert Corporation, Columbus, OH (US)

(72) Inventor: Zhiyong Lin, Dublin, OH (US)

(73) Assignee: Vertiv Corporation, Columbus, OH (US)

( * ) Notice: Subject to any disclaimer, the term of this patent is extended or adjusted under 35 U.S.C. 154(b) by 129 days.

(21) Appl. No.: 15/403,792

(22) Filed: Jan. 11, 2017

(65) Prior Publication Data

US 2017/0227259 A1 Aug. 10, 2017

Related U.S. Application Data

(60) Provisional application No. 62/292,469, filed on Feb. 8, 2016.

(51) Int. Cl.
*F25B 6/02* (2006.01)
*F24F 11/00* (2018.01)
(Continued)

(52) U.S. Cl.
CPC ..... *F25B 6/02* (2013.01); *F24F 3/044* (2013.01); *F24F 11/79* (2018.01); *F24F 13/10* (2013.01);
(Continued)

(58) Field of Classification Search
CPC .. F25B 6/02; F25B 11/79; F25B 13/10; F25B 11/0078; F25B 3/044; F25B 2400/0401; F25B 2400/161; F25B 41/04; F25B 2400/06; F25B 2600/2515; F25B 2600/2507
(Continued)

(56) References Cited

U.S. PATENT DOCUMENTS 2,318,893 A * 5/1943 Smith ..... F25B 5/02 165/249
2,474,304 A * 6/1949 Clancy ..... F25B 13/00 137/338
(Continued)

FOREIGN PATENT DOCUMENTS

WO WO-2008079138 A1 7/2008
WO WO-2016201172 A1 12/2016

OTHER PUBLICATIONS

International Search Report and Written Opinion for PCT/US2017/013882, dated Apr. 11, 2017.

*Primary Examiner* — Ljiljana Ciric
*Assistant Examiner* — Kirstin Oswald
(74) *Attorney, Agent, or Firm* — Harness, Dickey & Pierce, P.L.C.

(57) ABSTRACT

A hybrid air handler cooling unit has a bi-modal heat exchanger. In a direct expansion mode or a pumped refrigerant economization mode, the bi-modal heat exchanger is in a refrigerant path in parallel with first and second condenser coils and functions as a condenser coil. In a mixed direct expansion/pumped refrigerant economization mode, the bi-modal heat exchanger is in a refrigerant path in series between an outlet of a pump and an inlet of the first condenser coil and functions as a pre-cooler evaporator coil with return air first flowing across the bi-modal heat exchanger and then across an evaporator coil of an evaporator.

5 Claims, 6 Drawing Sheets

(51) Int. Cl.

| | |
|---|---|
| ***F24F 13/10*** | (2006.01) |
| ***F25B 41/04*** | (2006.01) |
| ***F24F 11/79*** | (2018.01) |
| ***F24F 3/044*** | (2006.01) |

(52) U.S. Cl.
CPC ..... *F25B 41/04* (2013.01); *F25B 2400/0401* (2013.01); *F25B 2400/06* (2013.01); *F25B 2400/161* (2013.01); *F25B 2600/2507* (2013.01); *F25B 2600/2515* (2013.01)

(58) Field of Classification Search
USPC ..... 62/427
See application file for complete search history.

(56) References Cited

U.S. PATENT DOCUMENTS 2,530,681 A * 11/1950 Clancy ..... F25B 13/00 62/324.1
2,893,218 A * 7/1959 Harnish ..... F24F 3/001 62/180
2,894,375 A * 7/1959 Waterfill ..... F24F 3/0522 62/196.4
2,907,178 A * 10/1959 McNatt ..... F24F 1/01 62/160
2,982,523 A * 5/1961 McFarlan ..... F24F 3/06 165/45
3,078,689 A * 2/1963 Japhet ..... F25B 6/02 62/324.3
3,314,246 A * 4/1967 Hopkins ..... F25B 15/06 62/101
3,358,469 A * 12/1967 Quick ..... F25B 5/02 62/183
3,837,175 A * 9/1974 Miller ..... F25B 43/02 62/151
3,841,393 A * 10/1974 Gilles ..... F24F 3/056 165/210
3,918,268 A * 11/1975 Nussbaum ..... F25B 47/006 62/150
3,995,446 A * 12/1976 Eubank ..... F24D 11/0285 137/625.46
4,099,553 A * 7/1978 Burnham ..... F24F 3/0442 165/101
4,100,763 A * 7/1978 Brody ..... F24D 11/0285 62/238.6
4,196,595 A * 4/1980 Shaw ..... F04C 18/16 62/160
4,242,872 A * 1/1981 Shaw ..... F24D 11/003 126/613
4,266,599 A * 5/1981 Saunders ..... F25B 13/00 165/239
4,300,623 A * 11/1981 Meckler ..... F24F 3/0522 165/210
4,304,100 A * 12/1981 Ibrahim ..... F25B 7/00 62/183
4,437,317 A * 3/1984 Ibrahim ..... F25B 47/022 62/152
4,760,707 A * 8/1988 Dennis ..... F25B 5/00 62/197
4,827,733 A * 5/1989 Dinh ..... F24F 1/022 62/119
5,193,352 A * 3/1993 Smith ..... F02C 7/143 62/201
5,497,629 A * 3/1996 Rafalovich ..... F24D 11/0214 62/199
5,651,257 A * 7/1997 Kasahara ..... C10M 107/34 252/68
5,673,567 A * 10/1997 Dube ..... F25B 6/00 62/117
5,688,433 A * 11/1997 Kasahara ..... C10M 107/34 252/67
5,797,275 A * 8/1998 Forsman ..... H05K 7/20381 62/175
6,094,925 A * 8/2000 Arshansky ..... F25B 25/005 62/151
6,684,653 B2 2/2004 Des Champs et al.
9,038,404 B2 5/2015 Judge et al.
9,055,696 B2 6/2015 Dunnavant
9,072,201 B2 6/2015 Bean, Jr.
9,140,475 B2 9/2015 Schrader et al.
2006/0266063 A1* 11/2006 Groll ..... F25B 1/10 62/228.5
2009/0229285 A1* 9/2009 Sato ..... F25B 41/00 62/149
2009/0293515 A1* 12/2009 Lifson ..... F24D 17/02 62/117
2011/0203299 A1* 8/2011 Jing ..... F25B 13/00 62/80
2011/0276182 A1* 11/2011 Seem ..... F25B 49/027 700/276
2012/0167610 A1 7/2012 Dunnavant
2012/0247132 A1* 10/2012 Lakdawala ..... F24F 5/0071 62/79
2012/0247135 A1* 10/2012 Fakieh ..... E03B 3/28 62/129
2012/0304674 A1* 12/2012 Schwarzkopf ..... B60H 1/00385 62/79
2013/0098086 A1 4/2013 Sillato et al.
2014/0013788 A1 1/2014 Kopko et al.
2014/0033753 A1 2/2014 Lu et al.
2015/0285539 A1* 10/2015 Kopko ..... F25B 5/02 62/115

* cited by examiner

Flow Control Valves
Flow States

| Flow Control Valve | DX Mode | PRE Mode | Mixed DX / Pre Mode |
|---|---|---|---|
| 118 | Open | Open | Closed |
| 120 | Open | Open | Closed |
| 122 | Closed | Closed | Open |
| 124 | Closed | Closed | Open |
| 126 | Open | Open | Closed |
| 128 | Closed | Open | Closed |
| 130 | Closed | Closed | Open |
| 132 | Open | Closed | Open |
| 134 | Open | Open | Closed |
| 136 | Closed | Open | Closed |
| 138 | Closed | Closed | Open |

Fig-5A

Damper Positions

| Damper | DX Mode | PRE Mode | Mixed DX / Pre Mode |
|---|---|---|---|
| 144 | Open | Open | Closed |
| 146 | Closed | Closed | Open |
| 148 | Open | Open | Closed |
| 150 | Closed | Closed | Open |
| 152 | Open | Open | Closed |

Fig-5B

HYBRID AIR HANDLER COOLING UNIT WITH BI-MODAL HEAT EXCHANGER

CROSS-REFERENCE TO RELATED APPLICATIONS

This application claims the benefit of U.S. Provisional Application No. 62/292,469 filed Feb. 8, 2016. The entire disclosure of the above application is incorporated herein by reference.

FIELD

The present disclosure relates to air handling systems for heating, ventilation and air conditioning ("HVAC") systems, and more particularly, to a hybrid air handling cooling unit with a bi-modal heat exchanger.

BACKGROUND

This section provides background information related to the present disclosure which is not necessarily prior art.

An air handler or air handling cooling unit conditions and circulates air as part of an HVAC system. The air handler cooling unit is the indoor portion of the HVAC system. The air handler cooling unit typically includes a blower (or fan), evaporator, and components of the ventilation system. In some cases where the HVAC system has an indoor condenser, the condenser is included in the air handler cooling unit.

SUMMARY

This section provides a general summary of the disclosure, and is not a comprehensive disclosure of its full scope or all of its features.

In accordance with an aspect of the present disclosure, a hybrid air handler cooling unit has a refrigerant circuit. The refrigerant circuit has a compressor, a condenser having first and second condenser coils, a pump, an expansion valve, an evaporator having an evaporator coil and a bi-modal heat exchanger. The hybrid air handler cooling unit has a direct expansion mode in which the compressor is running, the pump is off and the refrigerant circuit has a direct expansion only refrigerant flow path with the bi-modal heat exchanger in parallel with the first and second condenser coils. Refrigerant flows from the compressor in parallel through the first and second condenser coils and bi-modal heat exchanger with the bi-modal heat exchanger functioning as a condenser coil. In this direct expansion mode, refrigerant then flows from the first and second condenser coils and bi-modal heat exchanger through the expansion valve and from the expansion valve through the evaporator coil and from the evaporator coil to the compressor. In this direct expansion mode, the hybrid air handler cooling unit has a return air flow path in which return air flows across the evaporator coil but not across the bi-modal heat exchanger. The hybrid air handler cooling unit also has a pumped refrigerant economization mode in which the compressor is off, the pump is running and the refrigerant circuit has a pumped refrigerant economization only refrigerant flow path with the bi-modal heat exchanger in parallel with the first and second condenser coils. In this pumped refrigerant economization mode, refrigerant flows from the pump through the evaporator coil and from the evaporator coil through a valve around the compressor and from the compressor in parallel through the first and second condenser coils and bi-modal heat exchanger with the bi-modal heat exchanger functioning as a condenser coil, and back to the pump. In this pumped refrigerant economization mode, the hybrid air handler cooling unit has a return air flow path in which return air flows across the evaporator coil but not across the bi-modal heat exchanger. The hybrid air handler cooling unit also has a mixed direct expansion/pumped refrigerant economization mode in which the compressor and pump are both running and the refrigerant circuit has a mixed direct expansion refrigerant flow path and a mixed pumped refrigerant economization refrigerant flow path that are independent flow paths with the bi-modal heat exchanger in the pumped refrigerant economization refrigerant flow path in series between an outlet of the pump and an inlet of the second condenser coil and functions as a pre-cooler evaporator coil. In this mixed direct economization/pumped refrigerant economization mode, refrigerant flows in the mixed pumped refrigerant economization refrigerant flow path from the pump through the bi-modal heat exchanger and from the bi-modal heat exchanger through the second condenser coil and back to the pump, and refrigerant flows in the mixed direct expansion refrigerant flow path from the compressor through the first condenser coil and from the first condenser coil through the expansion valve and from the expansion valve through the evaporator coil and from the evaporator coil to compressor. In this mixed direct expansion/pumped refrigerant economization mode, the hybrid air handler unit also has a return air flow path in the where return air first flows across the bi-modal heat exchanger and then across the evaporator coil.

In an aspect, the refrigerant circuit has a plurality of flow control valves that intercouple the compressor, first and second condenser coils, pump, evaporator and bi-modal heat exchanger wherein the flow control valves are controlled by a controller configured to switch the flow controls valves among flow states providing the direct expansion only refrigerant flow path when the hybrid air handler cooling unit is in the direct expansion mode, the pumped refrigerant only refrigerant flow path when the hybrid air handler cooling unit is in the pumped refrigerant economization mode, and the mixed direct expansion refrigerant flow path and the mixed pumped refrigerant economization flow path when the hybrid air handler unit is in the mixed direct expansion/pumped refrigerant economization mode.

In an aspect, the hybrid air handler cooling unit includes a plurality of dampers that are controlled by the controller which is also configured to open and close the dampers to provide the return air flow paths when the hybrid air handler cooling unit is in any of the direct expansion mode, pumped refrigerant economization mode and the mixed direct expansion/pumped refrigerant economization mode.

In an aspect, the refrigerant circuit includes first and second receivers, wherein when the hybrid air handler unit is in the mixed direct expansion/pumped refrigerant economization mode flow control valves are switched to flow states to couple the first receiver in the pumped refrigerant economization refrigerant flow path in series between an outlet of the second condenser coil and an inlet of the pump and to couple the second receiver in the direct expansion refrigerant flow path between an outlet of the first condenser coil and an inlet of the evaporator coil. When the hybrid air handler cooling unit is in the direct expansion mode the flow control valves are switched to flow states to couple the second receiver in the direct expansion only refrigerant flow path between outlets of the first and second condenser coils and bi-modal heat exchanger and the inlet of the evaporator coil. When the hybrid air handler cooling unit is in the pumped refrigerant economization mode the flow control valves are switched to flow states to couple the second receiver in the pumped refrigerant economization only refrigerant flow path in series between the outlets of first and second condenser coils and bi-modal heat exchanger and the inlet of the pump.

In an aspect, the hybrid air handler cooling unit has a second refrigerant circuit having a second compressor, a second condenser having first and second condenser coils, a second pump, a second expansion valve, a second evaporator having an evaporator coil and a second bi-modal heat exchanger. In this aspect, when the hybrid air handler unit is in the direct expansion mode, the second refrigerant circuit has a second direct expansion only refrigerant flow path that is comparable to the direct expansion only refrigerant flow path of the first refrigerant circuit when the hybrid air handler unit is in the direct expansion mode, when the hybrid air handler unit is in the pumped refrigerant economization mode the second refrigerant circuit has a second pumped refrigerant economization only refrigerant flow path that is comparable to the pumped refrigerant economization only refrigerant flow path of the first refrigerant circuit when the hybrid air handler unit is in the pumped refrigerant economization mode, and when the hybrid air handler unit is in the mixed direct expansion/pumped refrigerant economization mode the second refrigerant circuit has a second mixed direct expansion refrigerant flow path and a second mixed pumped refrigerant economization refrigerant flow path that are comparable to the mixed direct expansion refrigerant flow path and mixed pumped refrigerant economization refrigerant flow path of the first refrigerant circuit. Also, the evaporators of the first and second refrigerant circuits arranged so that when the hybrid air handler cooling unit is in the direct expansion mode or the pumped refrigerant economization mode, return air flow across these evaporators in serial fashion, and the bi-modal heat exchangers of the first and second refrigerant circuits arranged so that when the hybrid air handler cooling unit is in the mixed direct expansion/pumped refrigerant economization mode, return air flows across these bi-modal heat exchangers in serial fashion and then across the evaporators of the first and second refrigerant circuits in serial fashion.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
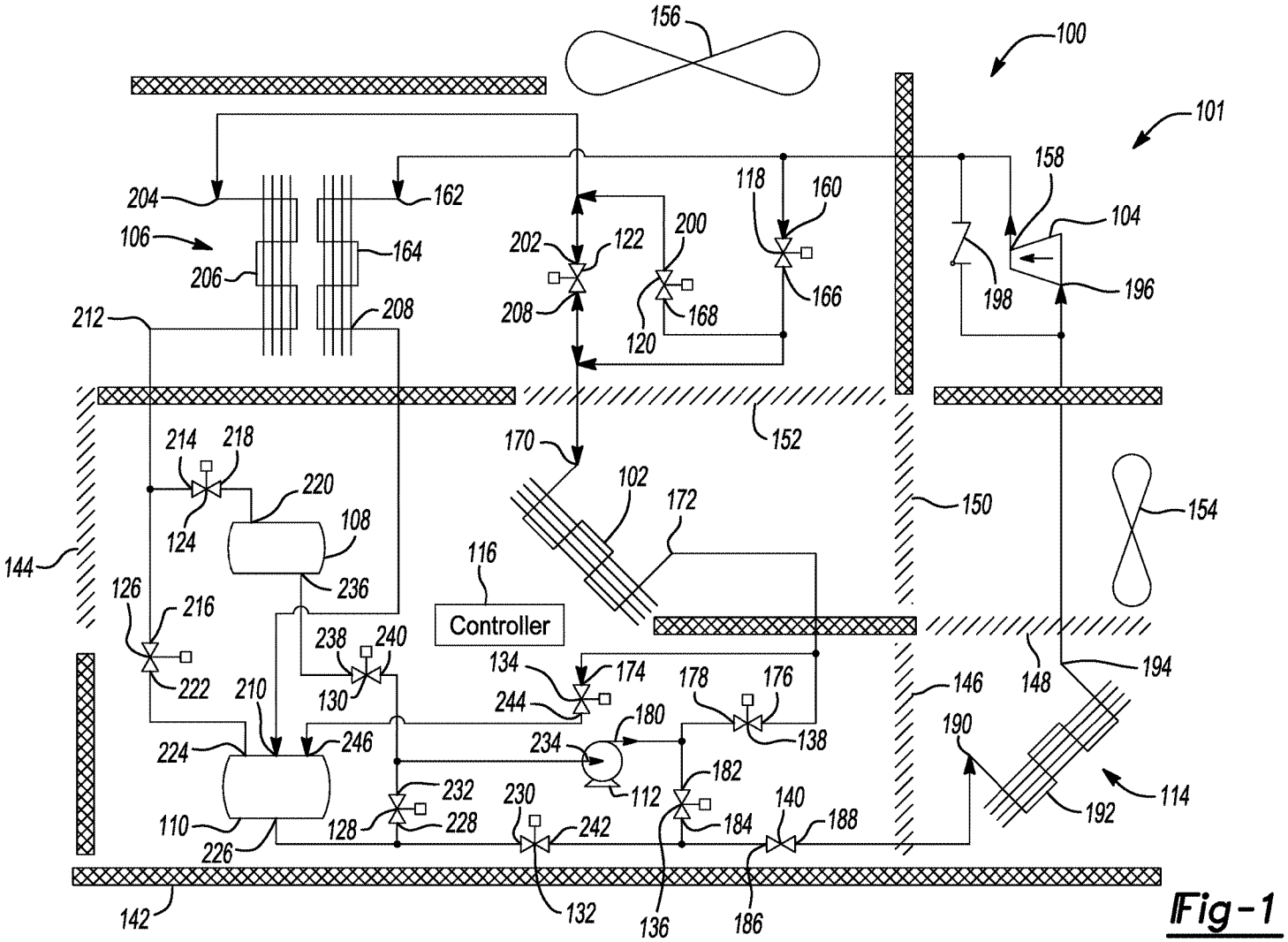
FIG. 1 is a simplified schematic of a topology of a hybrid air handler cooling unit having a bi-modal heat exchanger in accordance with an aspect of the present disclosure.
Figure 6:
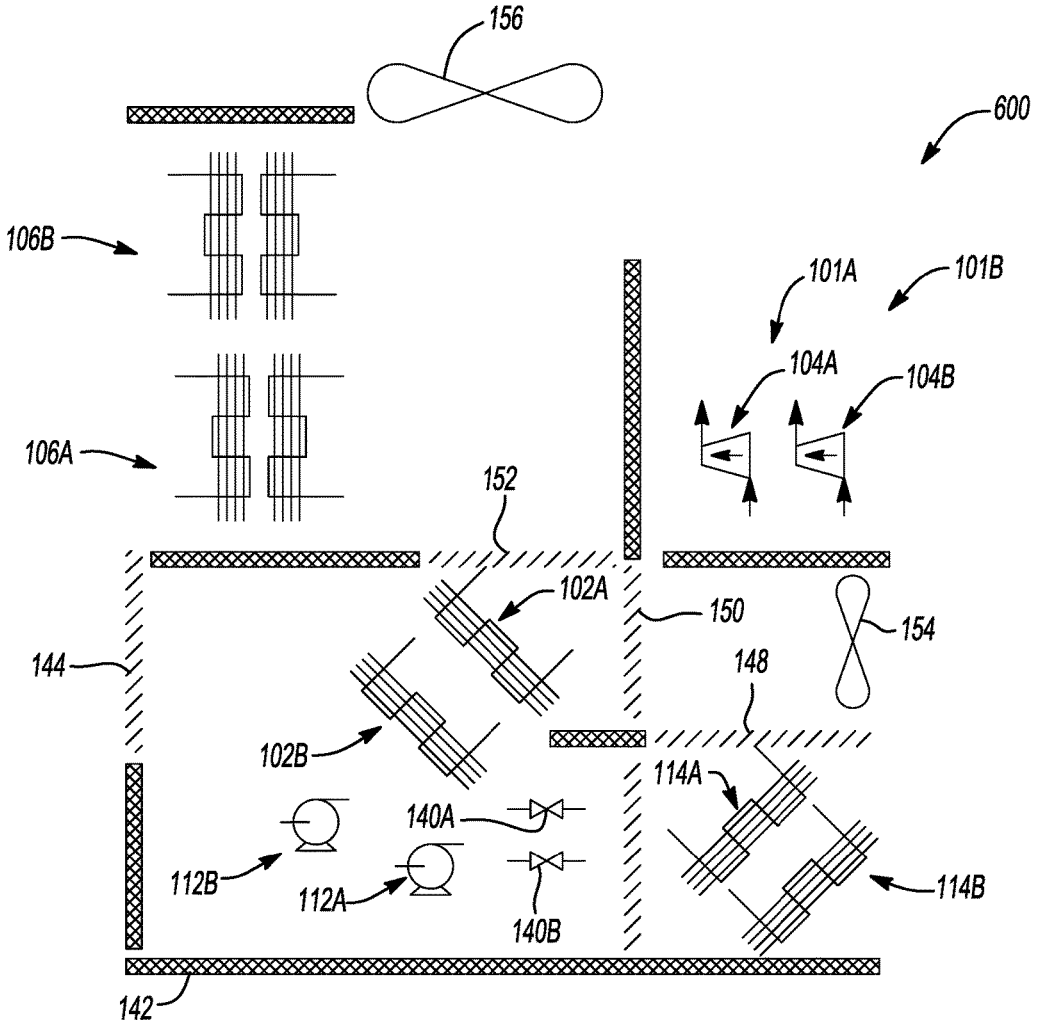

FIGS. 5A and 5B are state tables showing flow states of flow control valves and positions of dampers of the hybrid air handler cooling unit of FIG. 1 for the direct expansion mode, pumped refrigerant economization mode and mixed direct expansion/pumped refrigerant economization mode; and FIG. 6 is a simplified schematic of a hybrid air handler cooling unit in accordance with an aspect of the present disclosure having a plurality of comparable refrigerant circuits with each refrigerant circuit having a bi-modal heat exchanger.

Corresponding reference numerals indicate corresponding parts throughout the several views of the drawings.

DETAILED DESCRIPTION

Example embodiments will now be described more fully with reference to the accompanying drawings.

In accordance with an aspect of the present disclosure a hybrid air handler cooling unit has a refrigerant circuit having a direct expansion cooling mode, a pumped refrigerant cooling mode, and a mixed direct expansion/pumped refrigerant cooling mode. The refrigerant circuit includes a compressor, a pump, an evaporator and a bi-modal heat exchanger that operates as an evaporator or a condenser depending on the operating mode of the hybrid air handler cooling unit and a plurality of flow control valves intercoupling these components and switched by a controller configured to do so among flow control states to provide the different operating modes. The hybrid air handler cooling unit also includes dampers to regular the air flow path(s) in different operating modes.

FIG. 1 is a simplified schematic of a hybrid air handler cooling unit 100 having a refrigerant circuit 101 that includes a bi-modal heat exchanger 102 in accordance with an aspect of the present disclosure. In addition to bi-modal heat exchanger 102, the refrigerant circuit 101 includes a compressor 104 a condenser 106, receivers 108, 110, a pump 112, an evaporator 114, a controller 116, flow control valves 118, 120, 122, 124, 126, 128, 130, 132, 134, 136, 138 and an expansion valve 140 disposed in a cabinet 142. In an aspect, these flow control valves are motorized ball valves but it should be understood that they can be other types of controllable valves such as solenoid valves. Hybrid air handler cooling unit 100 also includes dampers 144, 146, 148, 150, 152 disposed in cabinet 142 which in some cases is in a wall cabinet 142 as described in more detail below. Hybrid air handler cooling unit 100 also includes evaporator air mover 154 disposed in an opening in a wall of cabinet 142 and a condenser air mover 156 disposed in an opening in a wall of cabinet 142, as described in more detail below. Air movers 154, 156 are illustratively fans or blowers. An outlet 158 of compressor 104 is fluidly coupled to an inlet port 160 of flow control valve 118 and to an inlet 162 of a first condenser coil 164 of condenser 106. An outlet port 166 of flow control valve 118 is fluidly coupled to an inlet port 168 of flow control valve 120 and to a first inlet/outlet 170 of bi-modal heat exchanger 102. A second inlet/outlet 172 of bi-modal heat exchanger 102 is fluidly coupled to an inlet port 174 of flow control valve 134 and to an outlet port 176 of flow control valve 138. As described in more detail below, refrigerant can flow through bi-modal heat exchanger in either direction depending on a mode of operation that hybrid air handler cooling unit 100 is in and depending on the direction of refrigerant flow, inlet/outlet 170 and inlet/outlet 172 provide either an inlet or an outlet of bi-modal heat exchanger 102.

An inlet port 178 of flow control valve 138 is fluidly coupled to an outlet 180 of pump 112 and to an inlet port 182 of flow control valve 136. An outlet port 184 of flow control valve 136 is coupled to an inlet port 186 of expansion valve 140 and an outlet port 188 of expansion valve 140 is coupled to an inlet 190 of an evaporator coil 192 of evaporator 114. An outlet 194 of evaporator coil 192 is fluidly coupled to an inlet 196 of compressor 104. A check valve 198 is fluidly coupled around compressor 104 between inlet 196 of compressor 104 and outlet 158 of compressor 104.

An outlet port 200 of flow control valve 120 is fluidly coupled to an inlet/outlet port 202 of bi-directional flow control valve 122 and to an inlet 204 of a second condenser coil 206 of condenser 106. A second inlet/outlet port 208 of bi-directional flow control valve 122 is coupled to inlet/outlet 170 of bi-modal heat exchanger 102.

An outlet 208 of first condenser coil 164 is fluidly coupled to a first inlet 210 of second receiver 110. An outlet 212 of second condenser coil 206 is fluidly coupled to an inlet port 214 of flow control valve 124 and to an inlet port 216 of flow control valve 126. An outlet port 218 of flow control valve 124 is coupled to an inlet 220 of first receiver 108. An outlet port 222 of flow control valve 126 is fluidly coupled to a second inlet 224 of second receiver 110. An outlet 226 of second receiver 110 is fluidly coupled to an inlet port 228 of flow control valve 128 and to an inlet port 230 of flow control valve 132. An outlet port 232 of flow control valve 128 is fluidly coupled to an inlet 234 of pump 112. An outlet 236 of first receiver 108 is fluidly coupled to an inlet port 238 of flow control valve 130 and an outlet port 240 of flow control valve 130 is fluidly coupled to inlet 234 of pump 112.

An outlet port 242 of flow control valve 132 is fluidly coupled to inlet port 186 of expansion valve 140. An outlet port 244 of flow control valve 134 is fluidly coupled to a third inlet 246 of second receiver 110.

Figure 2:
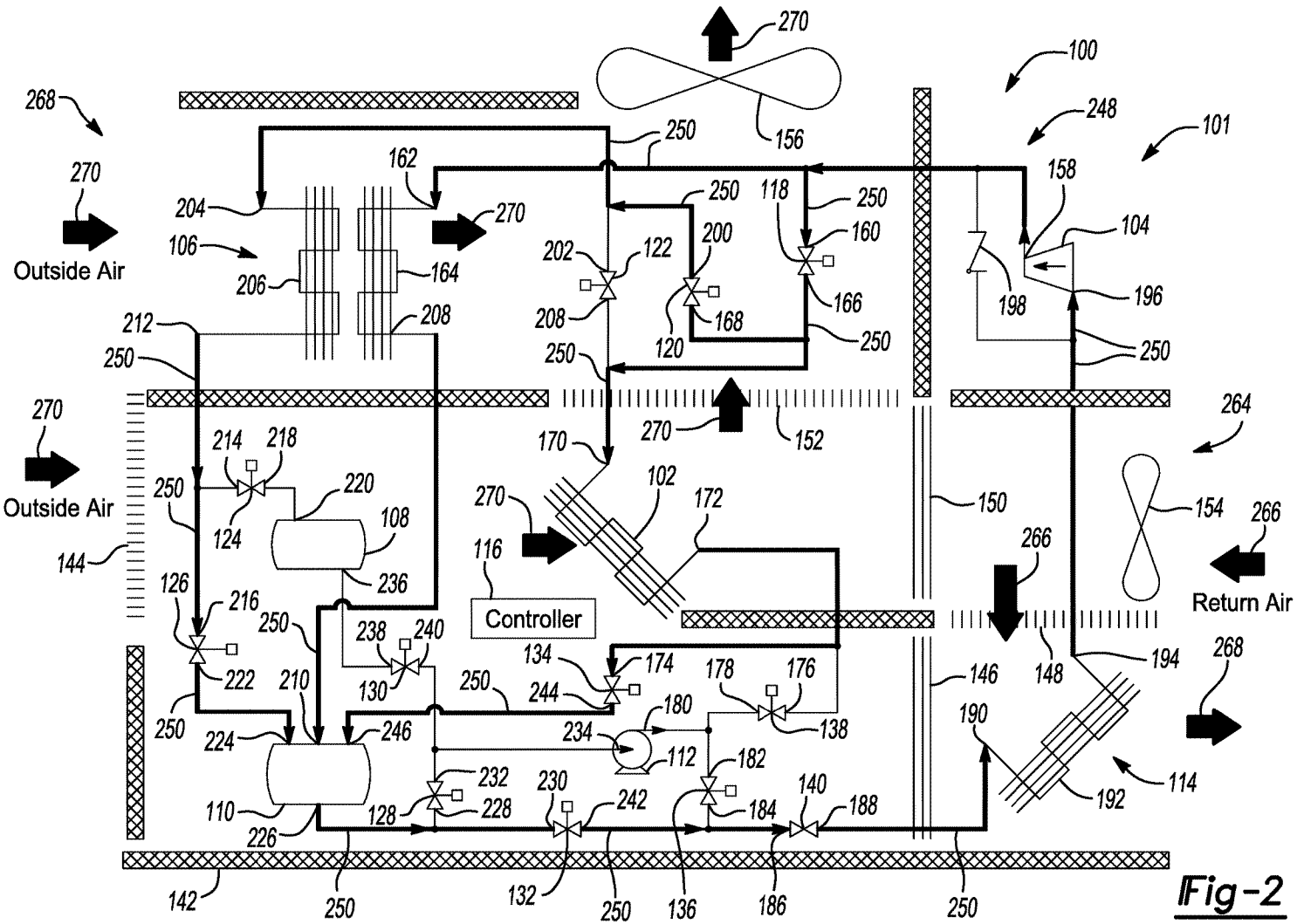
FIG. 2 is a simplified schematic of the hybrid air handler cooling unit of FIG. 1 in a direct expansion mode.
Figure 3:
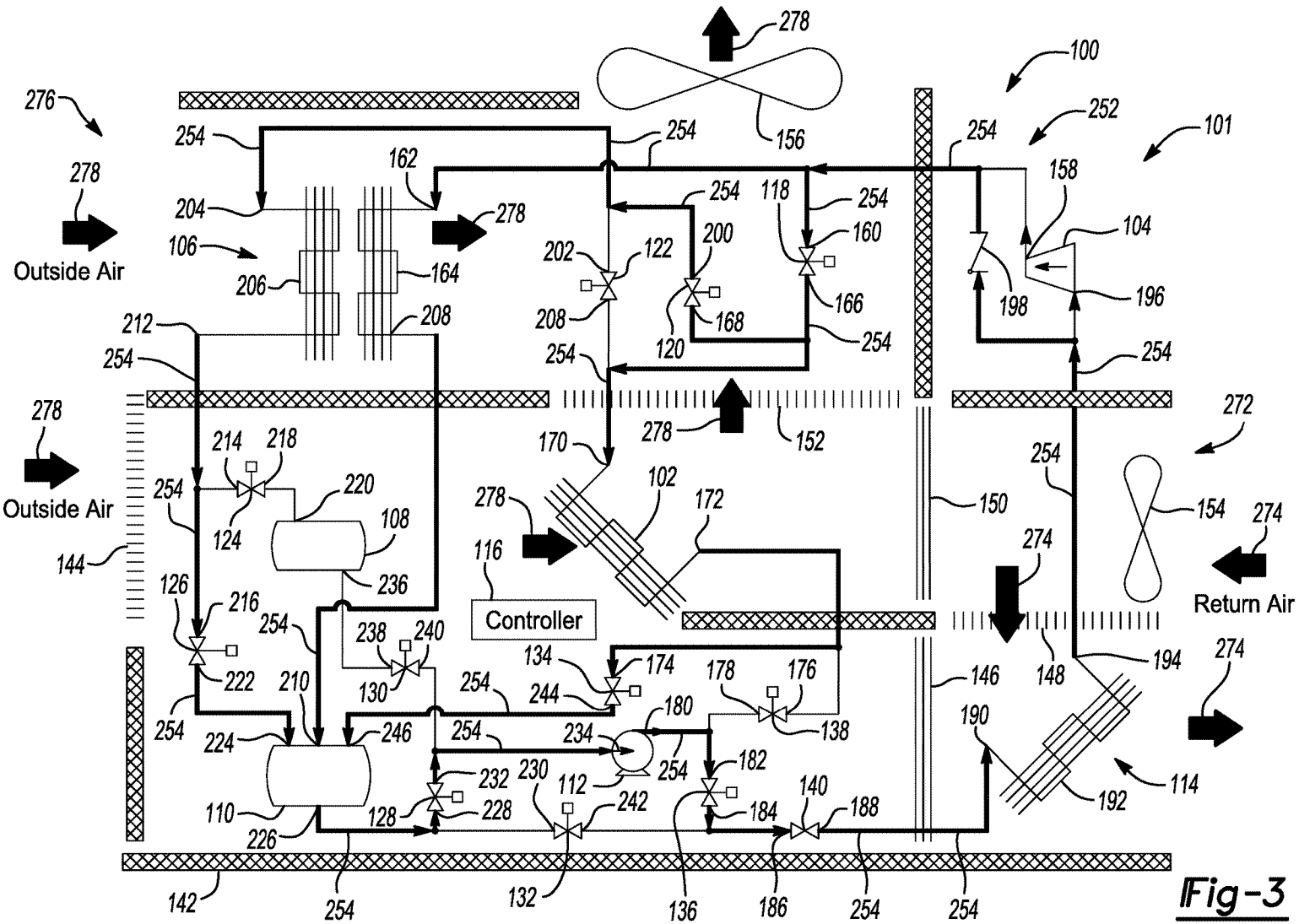
FIG. 3 is a simplified schematic of the hybrid air handler cooling unit of FIG. 1 in a pumped refrigerant economization mode.
Figure 4:
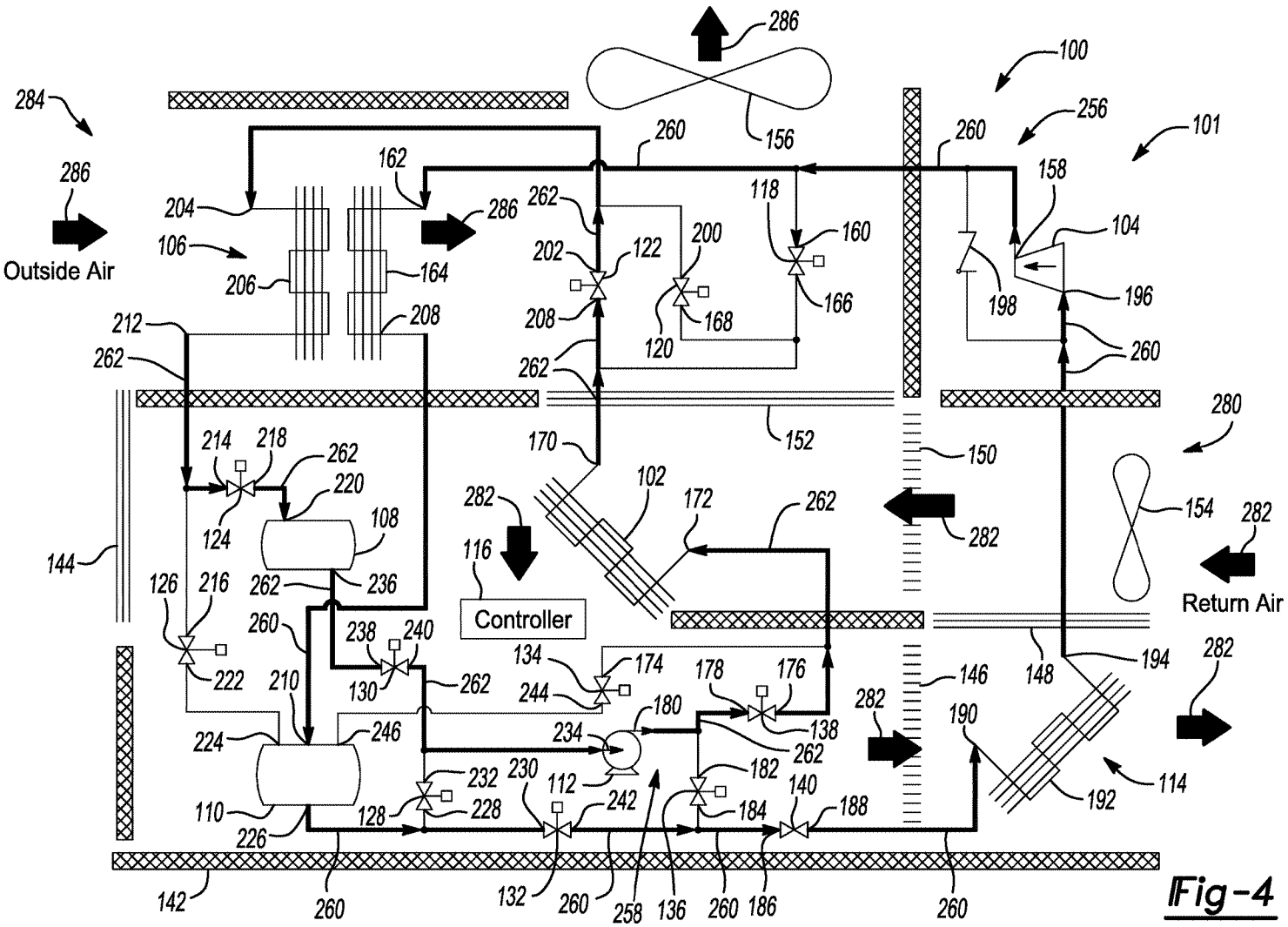
FIG. 4 is a simplified schematic of the hybrid air handler unit of FIG. 1 in a mixed direct expansion/pumped refrigerant economization mode.

Hybrid air handler cooling unit 100 includes a direct expansion mode in which refrigerant circuit 101 has a direct expansion only refrigerant flow path 248 shown by arrows 250 in FIG. 2, a pumped refrigerant economization mode in which refrigerant circuit 101 has a pumped refrigerant economization only refrigerant flow path 252 shown by arrows 254 in FIG. 3 and a mixed direct expansion/pumped refrigerant economization mode in which refrigerant circuit 101 has a mixed direct expansion refrigerant flow path 256 and a pumped refrigerant economization refrigerant flow path 258 that are independent flow paths and shown by arrows 260, 262 respectively in FIG. 4. In the direct expansion mode, the hybrid air handler cooling unit 100 has a return air flow path 264 shown by arrows 266 in FIG. 2 and an outside air flow path 268 shown by arrows 270 in FIG. 2. In the pumped refrigerant economization mode, the hybrid air handler cooling unit has a return air flow path 272 shown by arrows 274 in FIG. 3 and an outside air flow path 276 shown by arrows 278 in FIG. 3. In the mixed direct expansion/pumped refrigerant economization mode, hybrid air handler cooling unit has a return air flow path 280 shown by arrows 282 in FIG. 4 and an outside air flow path 284 shown by arrows 286 in FIG. 4.

Flow control valves 118, 120, 122, 124, 126, 128, 130, 132, 134, 136, 138 intercouple compressor 104, first and second condenser coils 164, 206 of condenser 106, pump 112, evaporator coil 192 of evaporator 114 and are controlled by controller 116 which is configured to switch these flow control valves among flow states that provide the direct expansion only refrigerant flow path when the hybrid air handler cooling unit is in the direct expansion mode, the pumped refrigerant only refrigerant flow path when the hybrid air handler cooling unit is in the pumped refrigerant economization mode, and the mixed direct expansion refrigerant flow path and the mixed pumped refrigerant economization flow path when the hybrid air handler unit is in the mixed direct expansion/pumped refrigerant economization mode. Dampers 146, 148, 150, which in an aspect are motorized dampers, are also controlled by controller 116 which is also configured to open and close dampers 146, 148, 150 to provide the return air flow paths 264, 268, 272 when the hybrid air handler cooling unit is in the direct expansion mode, pumped refrigerant economization mode and the mixed direct expansion/pumped refrigerant economization mode, respectively. Dampers 144, 152, which in an aspect are motorized dampers, are also controlled by controller 116 which is also configured to open and close dampers 144, 152 to provide outside air flow paths 268, 276 and 284 when hybrid air handler cooling unit is in the direct expansion mode, pumped refrigerant economization mode or mixed direct expansion/pumped refrigerant economization mode, respectively.

FIGS. 5A and 5B are state tables showing the flow states of the flow control valves and the positions of the dampers for the direct expansion mode, pumped refrigerant economization mode and the mixed direct expansion/pumped refrigerant economization mode. Controller 116 is configured with appropriate logic to control the flow control valves and dampers to be in the states and positions set forth in the state tables of FIGS. 5A and 5B when hybrid air handler cooling unit 100 is in the direct expansion mode, pumped refrigerant economization mode or the mixed direct expansion/pumped refrigerant economization mode. It should be understood that when it is indicated in FIG. 5A that a flow state of a flow control valve is open, it means that the flow control valve is open allowing fluid to flow through it and when it is indicated that the flow control is closed it means that the flow control valve is closed blocking fluid from flowing through it. Similarly, when it is indicated in FIG. 5B that a damper is open it means that air can flow through the damper and when it is indicated that the damper is closed it means that air is blocked from flowing through the damper.

With reference to FIG. 2, when hybrid air handler cooling unit 100 is in the direct expansion mode, the direct expansion only refrigerant flow path 248 has bi-modal heat exchanger 102 in parallel with the first and second condenser coils 164, 206 of condenser 106. Compressor 104 is running and pump 112 is off. Refrigerant flows from outlet 158 of compressor 104 to inlet 162 of first condenser coil 164 of condenser 106, through flow control valve 118 to inlet/outlet 170 of bi-modal heat exchanger 102, through flow control valve 120 to inlet 204 of second condenser coil 206 of condenser 106. Refrigerant then flows in parallel through first and second condenser coils 164, 206 and bi-modal heat exchanger 102 and then from outlet 212 of second condenser coil 206 through flow control valve 126 into second receiver 110 through inlet 224 of second receiver 110, from outlet 208 of first condenser coil 164 into second receiver 110 through inlet 210 of second receiver 110 and from inlet/outlet 172 of bi-modal heat exchanger 102 through flow control valve 134 into second receiver 110 through inlet 246 of second receiver 110. Refrigerant then flows from outlet 226 of second receiver 110 through flow control valve 132 and expansion valve 140 to inlet 190 of evaporator coil 192 of evaporator 114 and then through evaporator coil 192 and from outlet 194 of evaporator coil 192 to inlet 196 of compressor 104. Return air is cooled by flowing in return air flow path 264 across evaporator coil 192 of evaporator 114 but not across bi-modal heat exchanger 102. Outside air flows in outside air flow path 268 across first and second condenser coils 164, 206 of condenser 106 and across bi-modal heat exchanger 102 to cool first and second condenser coils 164, 206 and bi-modal heat exchanger 102. While FIG. 2 shows that the outside air flows in outside air flow path 268 serially across first and second condenser coils 164, 206, it should be understood that first and second condenser coils 164, 206 can be arranged so that the outside air flows across them in parallel.

When hybrid air handler cooling unit 100 is in the direct expansion mode, bi-model heat exchanger. functions as a condenser coil increasing the overall condenser coil surface area. In the illustrative embodiment, the hybrid air handler cooling unit effectively has three condenser coils when in direct expansion mode. By increasing the overall condenser coil surface area, the hybrid air handler cooling unit can operate in the direct expansion mode at a lower condensing pressure with less power consumption.

With reference to FIG. 3, when hybrid air handler cooling unit 100 is in the pumped refrigerant economization mode, the pumped refrigerant economization only refrigerant flow path 252 has bi-modal heat exchanger 102 in parallel with the first and second condenser coils 164, 206 of condenser 106. Compressor 104 is off and pump 112 is running. Refrigerant flows from outlet 180 of pump 112 through flow control valves 136 and expansion valve 140 to inlet 190 of evaporator coil 192 of evaporator 114 and then through evaporator coil 192 and from outlet 194 of evaporator coil 192 around compressor 104 through valve 198. It should be understood that in pumped refrigerant only refrigerant flow path 252, expansion valve 140 is either fully open (or partially open to maintain head pressure) and refrigerant flows through it or is bypassed such as by a bypass valve around (not shown) around it. Refrigerant then flows from valve 198 to inlet 162 of first condenser coil 164 of condenser 106, through flow control valve 118 to inlet/outlet 170 of bi-modal heat exchanger 102, and through flow control valve 120 to inlet 204 of second condenser coil 206 of condenser 106. Refrigerant then flows in parallel through first and second condenser coils 164, 206 and bi-modal heat exchanger 102 and then from outlet 212 of second condenser coil 206 through flow control valve 126 into second receiver 110 through inlet 224 of second receiver 110, from outlet 208 of first condenser coil 164 into second receiver 110 through inlet 210 of second receiver 110 and from inlet/outlet 172 of bi-modal heat exchanger 102 through flow control valve 134 into second receiver 110 through inlet 246 of second receiver 110. Refrigerant then flows from outlet 226 of second receiver 110 through flow control valve 128 to inlet 234 of pump 112. Return air is cooled by flowing in return air flow path 272 across evaporator coil 192 of evaporator 114 but not across bi-modal heat exchanger 102. Outside air flows in outside air flow path 276 across first and second condenser coils 164, 206 of condenser 106 and across bi-modal heat exchanger 102 to cool first and second condenser coils 164, 206 and bi-modal heat exchanger 102. It should be understood that return air flow paths 264 and 272 are the same as are outside air flow paths 268, 276.

When hybrid air handler cooling unit 100 is in the pumped refrigerant economization mode, bi-model heat exchanger also functions as a condenser coil increasing the overall condenser coil surface area. By increasing the overall condenser coil surface area, the hybrid air handler cooling unit can have full pump operation at higher outdoor temperatures. That is, hybrid air handler cooling unit 100 can run in the pumped refrigerant economization mode at higher outdoor temperatures before needing to switch to either the mixed direct expansion/pumped refrigerant economization mode or the direct expansion mode.

With reference to FIG. 4, when hybrid air handler cooling unit 100 is in the mixed direct expansion/pumped refrigerant economization mode, the compressor 104 and pump 112 are both running. The bi-modal heat exchanger is in series between outlet 180 of pump 112 and inlet/outlet 172 of bi-modal heat exchanger 102 and bi-modal heat exchanger functions as a pre-cooler evaporator coil. Refrigerant flows in the mixed pumped refrigerant economization refrigerant flow path from outlet 180 of pump 112, then through flow control valve 138, then through bi-modal heat exchanger 102, then through flow control valve 122 to inlet 204 of second condenser coil 206 of condenser 106, then from outlet 212 of second condenser coil 206 through flow control valve 124 into first receiver 108 through inlet 220 of first receiver 108. Refrigerant then flows out of first receiver 108 through outlet 236 of first receiver 108 through flow control valve 130 to inlet 234 of pump 112.

When the hybrid air handler cooling unit 100 is in the mixed direct expansion/pumped refrigerant economization mode, refrigerant also flows in the mixed direct expansion refrigerant flow path 256 from outlet 158 of compressor 104 through first condenser coil 164 of condenser 106, then from outlet 208 of first condenser coil 164 into second receiver 110 through inlet 210 of second receiver 110. Refrigerant then flows out second receiver 110 through outlet 226 of second receiver 110 through flow control valve 132 and expansion valve 140 to inlet 190 of evaporator coil 192 of evaporator 114. Refrigerant then flows through evaporator coil 192 and out of outlet 194 of evaporator coil 192 to inlet 196 of compressor 104.

When hybrid air handler cooing unit 100 is in the mixed direct expansion/pumped refrigerant economization mode, return is cooled by flowing in return air flow path 280 first across bi-modal heat exchanger 102 and then across evaporator coil 192. The return air is thus pre-cooled by bi-modal heat exchanger 102 before it flows across evaporator coil 192 for further cooling. This provides the advantage that the mixed pumped refrigerant economization refrigerant flow path can use free cooling as long as the outdoor air temperature is below the return air temperature. This allows more free cooling time especially for an outdoor temperature range between 40° F. to 70° F. Free cooling as is known in the art is directly using the temperature difference between return air and outdoor temperature to provide cooling. Outside air flows in outside air flow path 284 as shown by arrows 286 across first and second condenser coils 164, 206 to cool them. While FIG. 4 shows that the outside air flows in outside air flow path 284 serially across first and second condenser coils 164, 206, it should be understood that first and second condenser coils 164, 206 can be arranged so that the outside air flows across them in parallel.

It should be understood that an air handler can have a plurality of refrigerant circuits 101 located in cabinet 142. FIG. 6 is a simplified schematic of such an air handler 600 having two refrigerant circuits 101A and 101B. Refrigerant circuits 101A and 101B each have the components comparable to those described above with reference to refrigerant circuit 101 with the components for refrigerant circuit 101A having the suffix A after the applicable reference number and the components for refrigerant circuit 101B having the suffix B after the applicable reference number. To simplify the schematic of FIG. 6, only the bimodal heat exchangers 102A, 102B, compressors 104A, 104B, condensers 106A, 106B, pumps 112A, 112B, expansion valves 140A, 140B and evaporators 114A and 114B of refrigerant circuits 101A and 101B are shown in FIG. 6.

Hybrid air handler unit 600 has the direct expansion, pumped refrigerant economization and mixed direct expansion/pumped refrigerant economization modes with the refrigerant circuits 101A, 101B each having the refrigerant flow paths described above for these modes. That is, when hybrid air handler cooling unit 600 is in the direct expansion mode, refrigerant circuits 101A and 101B each have a respective direct expansion only refrigerant flow path 248. When hybrid air handler cooling unit 600 is in the pumped refrigerant economization mode, refrigerant circuits 101A and 101B each have a respective pumped refrigerant economization only refrigerant flow path 252. When hybrid air handler cooling unit 600 is in the mixed direct expansion/pumped refrigerant economization mode, refrigerant circuits 101A and 101B each have a respective mixed direct expansion refrigerant flow path 256 and pumped refrigerant economization flow path 258. In this regard, the refrigerant flow paths of each of the refrigerant circuits 101A, 101B are thus comparable to each.

In air handler cooling unit 600, evaporators 114A and 114B are arranged in cabinet 142 so that the return air flows across them in serial fashion, first over evaporator 114A and then over 114B. Bi-modal heat exchangers 102A and 102B are arranged in cabinet 142 so that when air handler cooling unit 600 is in the mixed direct expansion/pumped refrigerant economization mode, return air flows over them in serial fashion, first over bi-modal heat exchanger 102A and then over bi-modal heat exchanger 102B before flowing serially across evaporator 114A and evaporator 114B. When air handler cooling unit 600 is in the direct expansion mode or the pumped refrigerant economization mode, outside air flows across bi-modal heat exchangers 102A, 12B in serial fashion, first over bi-modal heat exchanger 102B and then over bi-modal heat exchanger 102A. It should be understood that air handler cooling unit 600 could have dampers (not shown) that would direct the outside air to flow across bi-modal heat exchangers 102A, 102B in parallel when air handler cooling unit 600 is in the direct expansion mode or the pumped refrigerant economization mode. Outside air flows across condensers 106A, 106B in the same manner as described above with regard to condenser 106.

It should be understood that the logic for the foregoing control of hybrid air handler cooling unit 100 by controller 116 illustratively can be implemented in hardware logic, software logic, or a combination of hardware and software logic. In this regard, controller 116 can be or can include any of a digital signal processor (DSP), microprocessor, microcontroller, or other programmable device which are programmed with software implementing the above described methods. It should be understood that alternatively it is or includes other logic devices, such as a Field Programmable Gate Array (FPGA), a complex programmable logic device (CPLD), or application specific integrated circuit (ASIC). When it is stated that controller 116 performs a function or is configured to perform a function, it should be understood that controller 116 is configured to do so with appropriate logic (such as in software, logic devices, or a combination thereof).

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A hybrid air handler cooling unit comprising:

a refrigerant circuit having a compressor, a condenser having first and second condenser coils, a pump, an expansion valve, an evaporator having an evaporator coil and a bi-modal heat exchanger;

the hybrid air handler cooling unit having a direct expansion mode in which the compressor is running, the pump is off and the refrigerant circuit has a direct expansion only refrigerant flow path with the bi-modal heat exchanger in parallel with the first and second condenser coils and refrigerant flows from the compressor in parallel through the first and second condenser coils and bi-modal heat exchanger with the bi-modal heat exchanger functioning as a condenser coil, from the first and second condenser coils and bi-modal heat exchanger through the expansion valve and from the expansion valve to the compressor and the hybrid air handler cooling unit has a return air flow path in which return air flows across the evaporator coil but not across the bi-modal heat exchanger;

the hybrid air handler cooling unit having a pumped refrigerant economization mode in which the compressor is off, the pump is running and the refrigerant circuit has a pumped refrigerant economization only refrigerant flow path with the bi-modal heat exchanger in parallel with the first and second condenser coils and refrigerant flows from the pump through the evaporator coil and from the evaporator coil through a valve around the compressor and from the compressor in parallel through the first and second condenser coils and bi-modal heat exchanger with the bi-modal heat exchanger functioning as a condenser coil, and back to the pump and the hybrid air handler cooling unit has a return air flow path in which return air flows across the evaporator coil but not across the bi-modal heat exchanger; and the hybrid air handler cooling unit having a mixed direct expansion/pumped refrigerant economization mode in which the compressor and pump are both running and the refrigerant circuit has a mixed direct expansion refrigerant flow path and a mixed pumped refrigerant economization refrigerant flow path that are independent flow paths with the bi-modal heat exchanger in the pumped refrigerant economization refrigerant flow path in series between an outlet of the pump and an inlet of the second condenser coil and functions as a pre-cooler evaporator coil with refrigerant flowing in the mixed pumped refrigerant economization refrigerant flow path from the pump through the bi-modal heat exchanger and from the bi-modal heat exchanger through the second condenser coil and back to the pump, and refrigerant flowing in the mixed direct expansion refrigerant flow path from the compressor through the first condenser coil and from the first condenser coil through the expansion valve and from the expansion valve to the compressor, and the hybrid air handler unit also has a return air flow path in the where return air first flows across the bi-modal heat exchanger and then across the evaporator coil.

2. The hybrid air handler cooling unit of claim 1 wherein the refrigerant circuit includes a plurality of flow control valves that intercouple the compressor, first and second condenser coils, pump, evaporator and bi-modal heat exchanger wherein the flow control valves are controlled by a controller configured to switch the flow controls valves among flow states providing the direct expansion only refrigerant flow path when the hybrid air handler cooling unit is in the direct expansion mode, the pumped refrigerant only refrigerant flow path when the hybrid air handler cooling unit is in the pumped refrigerant economization mode, and the mixed direct expansion refrigerant flow path and the mixed pumped refrigerant economization flow path when the hybrid air handler unit is in the mixed direct expansion/pumped refrigerant economization mode.

3. The hybrid air handler cooling unit of claim 2, including a plurality of dampers that are controlled by the controller which is also configured to open and close the dampers to provide the return air flow paths when the hybrid air handler cooling unit is in any of the direct expansion mode, pumped refrigerant economization mode and the mixed direct expansion/pumped refrigerant economization mode.

4. The hybrid air handler cooling unit of claim 2 wherein the refrigerant circuit includes first and second receivers, wherein when the hybrid air handler unit is in the mixed direct expansion/pumped refrigerant economization mode flow control valves are switched to flow states to couple the first receiver in the pumped refrigerant economization refrigerant flow path in series between an outlet of the second condenser coil and an inlet of the pump and to couple the second receiver in the direct expansion refrigerant flow path between an outlet of the first condenser coil and an inlet of the evaporator coil, when the hybrid air handler cooling unit is in the direct expansion mode the flow control valves are switched to flow states to couple the second receiver in the direct expansion only refrigerant flow path between outlets of the first and second condenser coils and bi-modal heat exchanger and the inlet of the evaporator coil, and when the hybrid air handler cooling unit is in the pumped refrigerant economization mode the flow control valves are switched to flow states to couple the second receiver in the pumped refrigerant economization only refrigerant flow path in series between the outlets of first and second condenser coils and bi-modal heat exchanger and the inlet of the pump.

5. The hybrid air handler cooling unit of claim 1 including a second refrigerant circuit having a second compressor, a second condenser having first and second condenser coils, a second pump, a second expansion valve, a second evaporator having an evaporator coil and a second bi-modal heat exchanger;

when the hybrid air handler unit is in the direct expansion mode, the second refrigerant circuit has a second direct expansion only refrigerant flow path that is comparable to the direct expansion only refrigerant flow path of the first refrigerant circuit when the hybrid air handler unit is in the direct expansion mode, when the hybrid air handler unit is in the pumped refrigerant economization mode the second refrigerant circuit has a second pumped refrigerant economization only refrigerant flow path that is comparable to the pumped refrigerant economization only refrigerant flow path of the first refrigerant circuit when the hybrid air handler unit is in the pumped refrigerant economization mode, and when the hybrid air handler unit is in the mixed direct expansion/pumped refrigerant economization mode the second refrigerant circuit has a second mixed direct expansion refrigerant flow path and a second mixed pumped refrigerant economization refrigerant flow path that are comparable to the mixed direct expansion refrigerant flow path and mixed pumped refrigerant economization refrigerant flow path of the first refrigerant circuit; and the evaporators of the first and second refrigerant circuits arranged so that when the hybrid air handler cooling unit is in the direct expansion mode or the pumped refrigerant economization mode, return air flow across these evaporators in serial fashion, and the bi-modal heat exchangers of the first and second refrigerant circuits arranged so that when the hybrid air handler cooling unit is in the mixed direct expansion/pumped refrigerant economization mode, return air flows across these bi-modal heat exchangers in serial fashion and then across the evaporators of the first and second refrigerant circuits in serial fashion.

* * * * *